United States Patent [19]

Smith

[11] 4,337,582

[45] Jul. 6, 1982

[54] METHODS FOR CONTROLLING VAPOR CONCENTRATIONS IN AN ATMOSPHERE

[75] Inventor: Stephen E. Smith, Wyckoff, N.J.

[73] Assignee: Airco, Inc., Montvale, N.J.

[21] Appl. No.: 192,582

[22] Filed: Sep. 30, 1980

[51] Int. Cl.[3] ..... F26B 3/04

[52] U.S. Cl. ..... 34/27; 34/32; 34/43; 34/76; 34/77

[58] Field of Search ..... 34/54, 48, 50, 77, 76, 34/29, 27, 32; 427/372.2, 335; 118/61, 58

[56] References Cited

U.S. PATENT DOCUMENTS

| | | | |
|---|---|---|---|
| 4,150,494 | 4/1979 | Rothchild | 34/77 |
| 4,150,495 | 4/1979 | Stern | 34/54 |
| 4,221,058 | 9/1980 | Zagorzycki | 34/54 |
| 4,245,397 | 1/1981 | Laar et al. | 34/54 |

*Primary Examiner*—Larry I. Schwartz

*Attorney, Agent, or Firm*—David L. Rae; Larry R. Cassett

[57] ABSTRACT

The degree of saturation of a vapor in a chamber such as a curing oven is controlled by sensing the vapor dew point and varying the rate of removal of such vapor from the oven in response to a comparison of the sensed dew point with a predetermined dew point. This comparison may also be effected by comparing the difference between the actual dew point and oven temperature with a predetermined difference and controlling the rate of vapor removal in response to variations between the actual and predetermined differences. Alternately, a predetermined ratio between dew point and oven temperature may be maintained. By controlling the dew point of the vapor, i.e. degree of saturation, condensation in the oven is precluded while still permitting high solvent vapor concentrations which in turn facilitate recovery of solvent exhausted or removed from the oven.

2 Claims, 1 Drawing Figure

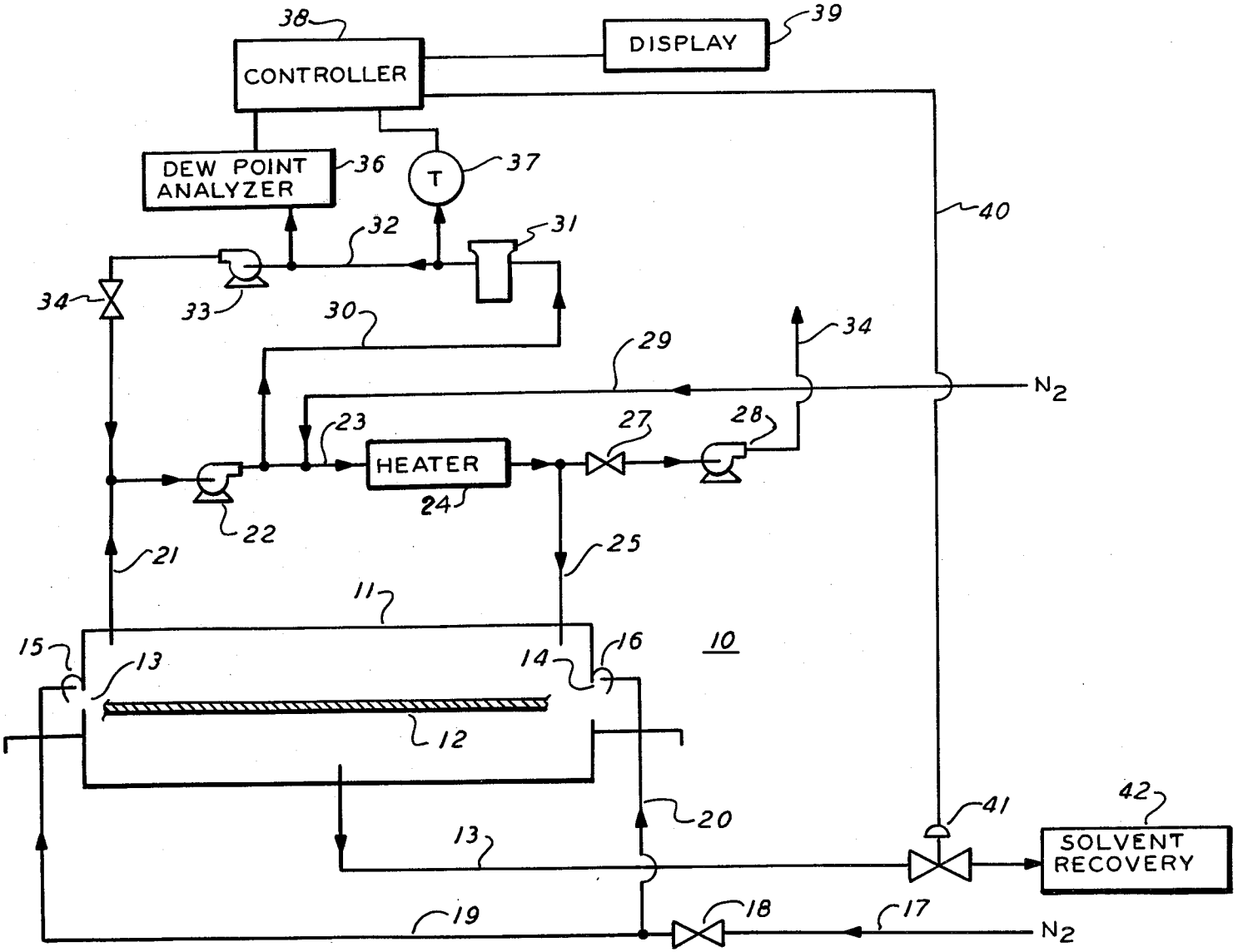
DISPLAY
CONTROLLER
DEW POINT ANALYZER
HEATER
SOLVENT RECOVERY
$N_2$
$N_2$
T
10
11
12
13
14
15
16
17
18
19
20
21
22
23
24
25
27
28
29
30
31
32
33
34
34
36
37
38
39
40
41
42

METHODS FOR CONTROLLING VAPOR CONCENTRATIONS IN AN ATMOSPHERE

BACKGROUND OF THE INVENTION

The present invention relates to methods and apparatus for controlling the degree of saturation in a chamber and more particularly to the control of solvent vapor concentrations in a curing oven.

Techniques for curing solvent borne coatings on materials passed through curing ovens have typically included supplying massive air flows through the oven to maintain the solvent vapor concentration of the oven atmosphere below explosive levels. However, as these extremely large air flows remove heat from curing ovens, which typically operate at temperatures between 200°–600° F., considerable quantities of energy in the form of heat are required to cure such solvent borne resin coatings. More recently, it has been proposed to discard the foregoing traditional approach toward curing of solvent borne resin coatings by introducing an inert gas into a curing oven at a flow rate sufficient to maintain oxygen levels below limits of combustibility, i.e. 4%. This technique, which is described in U.S. Pat. No. 4,150,494 and which is assigned to the assignee of the present invention, enables the efficient recovery of solvent vapor by permitting relatively high degrees of solvent vapor saturation (concentrations) in the curing oven which in turn facilitates the condensation of solvent vapor exhausted or removed from the oven. By the technique described in this patent, solvent can be recovered by condensing the withdrawn solvent vapor against a refrigerant such as liquid nitrogen which in turn is vaporized and is supplied to the oven as an inert gas.

In addition to the aforementioned technique for inerting curing ovens, it has also been determined that inert gas flows to such ovens must be controlled in order to assure that desired, low oxygen levels are maintained in the oven and that excessive quantities of inert gas are not consumed or lost to ambient atmosphere. Such a technique for controlling inert gas flows to a curing oven is described in U.S. Pat. No. 4,223,450 which is also assigned to the assignee of the present invention. However, neither of the aforementioned techniques, although relying upon high degrees of solvent vapor saturation in curing ovens, fully enable the degree of saturation of such vapor to be controlled upon variations of oven temperatures and/or the degree of solvent loading with respect to a given coating. It will be understood that as essentially continuous material bearing coatings to be cured is passed through a curing oven, the amount of solvent per unit length of coating may change from one section of such material to another and consequently, the rate at which solvent vapor is introduced into the oven atmosphere may vary substantially during operation of the curing oven. In these latter circumstances and, upon certain temperature variations, an oven atmosphere which exhibits a high degree of solvent vapor saturation may result in a condensation of such solvent vapor in the oven itself or associated piping or incomplete curing of the resin coating. Although oxygen levels are maintained below limits of combustibility, this condensed solvent is not recovered and its presence in an oven is considered to be a potentially hazardous condition and one which should be avoided.

Consequently, there is a need to develop techniques for controlling the degree of solvent vapor saturation in curing ovens or the like to assure that condensation of such vapors in the oven is avoided but concurrently enabling high solvent vapor concentrations to exist to render economic the recovery of solvent vapors withdrawn from the oven. Again, the higher the degree of solvent vapor saturation in a withdrawn or exhaust stream, the less refrigeration and hence energy is required to recover the same by way of condensation and it is these dual objectives of avoiding condensation in the oven yet enabling high degrees of solvent vapor saturation to exist therein which are sought to be attained by the present invention.

OBJECTS

It is an object of the present invention to provide improved methods for controlling the degree of saturation of a vapor in a chamber.

It is another object of the invention to control the degree of saturation of vapor in a chamber without complicated and expensive instrumentation and control equipment.

It is still another object of the present invention to provide improved methods and apparatus for curing solvent borne resin coatings in ovens from which solvent vapor is recovered.

It is still another object of the present invention to maintain high degrees of solvent vapor saturation in inerted curing ovens without condensation of such vapor therein.

It is yet another object of the present invention to reliably control the degree of saturation of solvent vapor in a curing oven notwithstanding variations in oven temperature and changes in solvent loadings of coatings being cured therein.

Other objects of the present invention will become apparent from the following description of exemplary embodiments thereof which follows and the novel features will be particularly pointed out in conjunction with the claims appended hereto.

SUMMARY

In accordance with the invention, the degree of saturation of a vapor in a chamber is controlled by maintaining a predetermined dew point of the vapor notwithstanding changed conditions in the chamber. The actual vapor dew point may be compared with a predetermined dew point or a predetermined difference between the chamber temperature and the vapor dew point temperature may be maintained. This temperature difference is maintained at a value sufficiently great to preclude condensation of the vapor yet enables a high degree of vapor saturation which is beneficial to the efficient recovery of such vapor after removal from the chamber. Alternately, a predetermined ratio between the vapor dew point and the chamber temperature may be maintained. Preferably, the aforementioned predetermined temperature difference is established and maintained by removing the chamber atmosphere at a rate such that the partial pressure or degree of saturation of the vapor in the chamber corresponds to a dew point temperature which enables such difference in temperature to be established and maintained. Control over the rate of vapor removal is particularly effective when the vapor is being continuously introduced into the chamber atmosphere as occurs during the curing of solvent borne resins on materials being passed through a curing oven.

Thus, the chamber may comprise an inerted curing oven and the vapor may be a solvent evaporated from a material passed therethrough on which material a solvent borne coating is being cured. The oven atmosphere is typically removed to enable recovery of the solvent and the difference between the solvent vapor dew point temperature and oven temperature is maintained at a predetermined value to preclude condensation of such vapor in the oven or in associated piping and conduits. In order to maintain the aforementioned predetermined temperature difference, the rate of vapor removal is preferably controlled but the same result can be achieved by varying the oven or chamber temperature for controlling the rate at which the vapor is formed in the particular oven or chamber. However, it is generally preferred to maintain a particular oven temperature and uniform rate of passing a material bearing such coating therethrough.

The vapor in the chamber may be a mixture of two or more miscible vapors which exhibit a single dew point temperature or two or more non-miscible vapors may be present. In the latter case, a dew point analyzer which is effective to determine the highest dew point temperature of vapors in a chamber is utilized in establishing and maintaining the predetermined temperature difference or ratio between such dew point and the oven temperature so as to preclude condensation in the chamber.

BRIEF DESCRIPTION OF THE DRAWING

The invention will be more clearly understood by reference to the following description of exemplary embodiments thereof in conjunction with the following drawing in which:

The sole FIGURE is a diagrammatic view of an exemplary embodiment of apparatus for enabling the degree of saturation of vapor in a chamber to be controlled.

DESCRIPTION OF PREFERRED EMBODIMENT

Referring now to the drawing, illustrated therein is an exemplary embodiment of apparatus 10 for controlling the degree of saturation of a vapor in an oven 11 which is provided with means for reheating the oven atmosphere, oven temperature sensing and dew point analyzer means and means for varying the rate at which the vapor is removed from the oven. In order to clearly describe the method and apparatus according to the invention, chamber 11 will hereafter be referred to as an oven although it will be understood that other chambers, such as drying chambers, may be provided with apparatus for controlling the degree of saturation of a vapor therein in accordance with the invention.

Oven 11 is preferably provided with means (not shown) for translating a web or other material 12 therethrough to which web a coating, e.g. a solvent borne resin coating, is applied. Typically, oven 11 is heated to a temperature between approximately 200°-600° F. to enable the curing of such resin coating which concurrently results in the evaporation of the solvent to form a solvent vapor in oven 11. A relatively small, bleed flow of the solvent vapor is removed from oven 11 through conduit 13 and valve 41 and is collected in a solvent recovery system which may comprise the apparatus illustrated in U.S. Pat. No. 4,150,494. Web 12 is passed into oven 11 through entrance 13 and is withdrawn through exit 14 which are respectively provided with inert gas curtain devices 15 and 16. A flow of inert gas such as nitrogen may be supplied through conduit 17, valve 18 and conduits 19 and 20 to gas curtain devices 15 and 16, respectively. The inert gas emitted by such curtain devices is effective to preclude the entry of ambient oxygen into oven 11 and a portion of such inert gas will enter the oven and cooperate with make-up inert gas supplied through conduit 29 to assure that oxygen levels below levels of combustibility are maintained.

The atmosphere in oven 11 which is essentially comprised of solvent vapor and inert gas is removed through conduit 21 and passed by blower 22 through line 23 to a heater 24 and then through conduit 25 back into oven 11. As those skilled in the art will appreciate, recirculation of the oven atmosphere enables the temperature thereof to be maintained by the operation of heater 24 and thus, the heat content of such atmosphere is augmented in an efficient manner. Make-up inert gas supplied through conduit 29 to conduit 23 is thus heated along with the recirculating oven atmosphere to approximately the temperature of oven 11 so that make-up inert gas does not cool the oven below a desired operating temperature when introduced therein. A valve 27 and blower 28 are provided to enable the recirculating oven atmosphere to be exhausted to ambient during a purge and exhaust mode of operation. During normal operation of oven 11, valve 27 is closed and blower 28 is not activated.

In order to control the degree of saturation of solvent vapor in oven 11, a portion of the recirculating atmosphere is withdrawn through conduit 30 and filter 31 by means of blower 33 and returned through valve 34 to the inlet of blower 22. The temperature of the recirculating atmosphere which corresponds to the oven temperature is sensed by suitable temperature sensing means 37. A dew point analyzer 36 is disposed so as to sense the actual dew point (temperature) of the oven atmosphere supplied through conduit 32 and as mentioned previously, this analyzer is effective to sense the highest dew point of components of such atmosphere. Thus, in accordance with the invention, analyzer 36 will provide an indication of the dew point of the solvent vapor as this vapor will exhibit a higher dew point than will nitrogen. In the event that there are several distinct and non-miscible solvents utilized in the curing of coatings on web 12, analyzer 36 will indicate the highest dew point temperature of such solvent vapors. Blower 33 is effective to return the oven atmosphere in conduit 32 through valve 34 to the inlet of blower 22.

The actual dew point sensed by analyzer 36 as mentioned above is effectively compared with a predetermined dew point by controller 38 which in turn provides an output signal over line 40 representative of the difference between such dew points. A suitable comparison can also be effected by supplying the outputs of temperature sensor 37 and dew point analyzer 36 to controller 38 wherein the difference between such temperatures is calculated and compared to a predetermined temperature difference. This predetermined temperature difference is established so as to be greater than the difference between the highest dew point of vapor in the oven atmosphere and the oven temperature. In the event the analyzer 36 detects a dew point temperature which approaches the temperature of oven 11 which will tend to initiate condensation of the vapor, controller 38 will provide an output signal over line 40 which will control valve 41 so as to vary the rate of removal of solvent vapor from oven 11 in a manner to be described below.

During the curing of coatings on web 12, the rate of evaporation of solvent may vary due to differences in the loading or amount of solvent per unit length of web, and hence, the degree of saturation of solvent vapor will vary. In the event the loading of solvent in such coatings increases, the rate of evaporation of solvent will increase in oven 11 and, therefore, the degree of saturation of solvent vapor in the oven atmosphere will increase. Thus, the oven atmosphere will exhibit a higher dew point temperature and consequently, the difference between the actual dew point temperature of solvent vapor and a predetermined or desired dew point will increase and the difference between the actual dew point and the oven temperature will be reduced. This reduced difference will be compared against a predetermined temperature difference by controller 38. Upon the actual temperature difference falling below the predetermined temperature difference, controller 38 will supply an electrical signal over line 40 to control valve 41. In the foregoing instance, valve 41 will be opened to thereby permit a greater flow of oven atmosphere through conduit 13 to solvent recovery means 42 and as the flow of make-up inert gas through conduit 29 and gas curtains 15–16 will remain substantially constant, the degree of saturation of solvent vapor within oven 11 will begin to decrease which in turn will be reflected as a reduced dew point temperature. In this manner, the predetermined temperature difference between the highest dew point temperature of vapor in oven 11 and a predetermined dew point or the oven temperature therein will be maintained to assure that conditions under which solvent vapor may condense within oven 11 are averted.

It will be understood that although the apparatus illustrated in the drawing constitutes an essentially automatic system for controlling the degree of saturation of solvent vapor in oven 11, such control can also be effected manually. For example, display 39 which is coupled to controller 38 may be energized so as to display the actual temperature difference between the oven temperature and the highest dew point temperature of a vapor therein. An operator observing such actual temperature difference may then manually control a valve (not shown) in a conduit 13 which would essentially replace control valve 41 and thus manually control the flow of oven atmosphere to solvent recovery means 42. In this manner, the degree of saturation of the solvent vapor in oven will be controlled and condensation will be averted.

In the operation of apparatus according to the invention, it is preferred to establish the degree of saturation of solvent vapor as close as possible to the dewpoint thereof to enable the most efficient recovery of such vapor withdrawn through conduit 13. Although condensation of solvent vapor in oven 11 will be precluded under these circumstances, a somewhat lesser degree of saturation of solvent vapor may be required in order to assure a complete curing of the resin coating applied to web 12. By maintaining relatively high degrees of saturation of solvent vapor in the oven atmosphere, the driving force evaporating solvent from a web is reduced, i.e. the resistance of the atmosphere to receive further amounts of solvent vapor increases and consequently, it may be necessary to maintain somewhat lower degrees of saturation of solvent vapor than is theoretically possible while still avoiding condensation. Those skilled in the art will appreciate, however, that the optimum degree of saturation of solvent vapor will vary depending upon several conditions including the chemical composition of coatings and solvents and the loading of solvent on a given length of web material, web speed, etc.

In summary, the methods and apparatus according to the present invention enable the degree of saturation of vapor in an atmosphere to be readily controlled and maintained with commercially available equipment which may be readily adapted to existing curing ovens.

The foregoing and other various changes in form and details may be made without departing from the spirit and scope of the present invention. Consequently, it is intended that the appended claims be interpreted as including all such changes and modifications.

What is claimed is:

1. The method of maintaining a predetermined degree of saturation of solvent vapor in a curing oven to which an inert gas is supplied while the oven is maintained at a temperature between 200°–600° F. such that the one or more solvents in a solvent borne resin coating on a material passed through said oven is evaporated to form an oven atmosphere comprised of inert gas and one or more evaporated solvent vapor which atmosphere is removed from said oven, the improvement comprising:

(a) sensing the temperature of the oven atmosphere;

(b) determining the highest dew point of the solvent vapors in the oven atmosphere;

(c) establishing a predetermined dew point below said oven temperature and establishing a predetermined difference value;

(d) subtracting said highest dew point from said predetermined dew point to determine the actual difference therebetween; and (e) comparing said actual difference and said predetermined difference and varying the rate of removing solvent vapor in response to said comparison to maintain said actual difference at a value greater than said predetermined difference and said predetermined degree of saturation without condensation of said solvent vapors.

2. The method of maintaining a predetermined degree of saturation of solvent vapor in a curing oven to which an inert gas is supplied while the oven is maintained at a temperature between 200°–600° F. such that the one or more solvents in a solvent borne resin coating on a material passed through said oven is evaporated to form an oven atmosphere comprised of inert gas and one or more evaporated solvent vapor which atmosphere is removed from said oven, the improvement comprising:

(a) sensing the temperature of the oven atmosphere;

(b) determining the highest dew point of the solvent vapors in the oven atmosphere;

(c) establishing a predetermined dew point temperature below said oven temperature;

(d) dividing said predetermined dew point temperature by said oven temperature to establish a predetermined ratio therebetween;

(e) dividing said highest dew point of said solvent vapors by said oven temperature to obtain an actual ratio therebetween; and (f) comparing said actual and predetermined ratios and varying the rate of removing solvent vapor from the oven atmosphere to maintain said actual ratio at a value below said predetermined ratio.

* * * * *